United States Patent [19]

Nakayama

[11] Patent Number: 4,732,017

[45] Date of Patent: Mar. 22, 1988

[54] APPARATUS FOR TREATMENT

[75] Inventor: Kiyoshi Nakayama, Kurobe, Japan

[73] Assignee: Yoshida Kogyo K. K., Tokyo, Japan

[21] Appl. No.: 945,890

[22] Filed: Dec. 24, 1986

[30] Foreign Application Priority Data

Dec. 26, 1985 [JP] Japan ..... 60-201260[U]

[51] Int. Cl.[4] ..... D06B 5/18

[52] U.S. Cl. ..... 68/150

[58] Field of Search ..... 68/150, 189

[56] References Cited

U.S. PATENT DOCUMENTS 3,100,979 8/1963 Stanway ..... 68/150
3,199,752 8/1965 Casse ..... 68/189 X
4,206,619 6/1980 Fukuroi et al. ..... 68/20

FOREIGN PATENT DOCUMENTS 4318782 8/1968 Japan .
443252 2/1969 Japan .

*Primary Examiner*—Philip R. Coe
*Attorney, Agent, or Firm*—Hill, Van Santen, Steadman & Simpson

[57] ABSTRACT

An apparatus for treating textile materials has an impeller or vane wheel which is disposed in a flow passageway communicating with a circulatory pump and with the interior of a perforated cylindrical beam and which is connected to a shaft of the beam.

5 Claims, 4 Drawing Figures

APPARATUS FOR TREATMENT

BACKGROUND OF THE INVENTION

1. Field of the Invention

The present invention relates to an apparatus for treatment, such as dyeing and bleaching, of textile materials wound on a perforated cylindrical beam, and more particularly to an improved drive mechanism for rotating the beam.

2. Description of the Prior Art

There are known a variety of apparatus for forcing treatment liquid, such as dyeing and bleaching liquid, into and through textile materials such as yarns, tapes and fabrics that are wound on a rotating perforated cylinder commonly known as "beam". In an example disclosed in Japanese Utility Model Post-Examination Publication No. 43-18782, an axial shaft of the beam is connected to a driving shaft disposed outside a treatment vessel of the apparatus for rotation of the beam. In another example disclosed in Japanese Patent Post-Examination Publication No. 44-3252, a gear mounted on a support frame of the beam meshes with another gear mounted on a driving shaft extending into a treatment vessel from the outside for rotation of the beam support frame. Difficulties have been experienced with such prior treatment apparatus in that since the driving shaft must extend into the treatment vessel from outside and since the vessel is maintained interiorly in very high pressure condition, it is required to seal about the driving shaft so as to maintain the interior of the vessel at high pressure during the treating. A drive means such as a motor or a speed reducer is also required. Moreover, it is required to take measures for safety against the strain on the driving shaft resulting from any abnormal rotation, thus increasing the costs of installation and maintenance.

SUMMARY OF THE INVENTION

It is therefore an object of the present invention to provide an apparatus for treating textile materials in which apparatus a perforated cylindrical beam is rotated by utilizing the liquid flow pressure of a circulatory pump, thus requiring not only so special sealing measure for high pressure, but also no drive mechanism outside a treatment vessel of the apparatus.

According to the present invention, an apparatus for treating textile materials has an impeller or vane wheel which is disposed in a flow passageway communicating with a circulatory pump and with the interior of a perforated cylindrical beam and which is connected to a shaft of the beam.

Many other advantages, features and additional objects of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
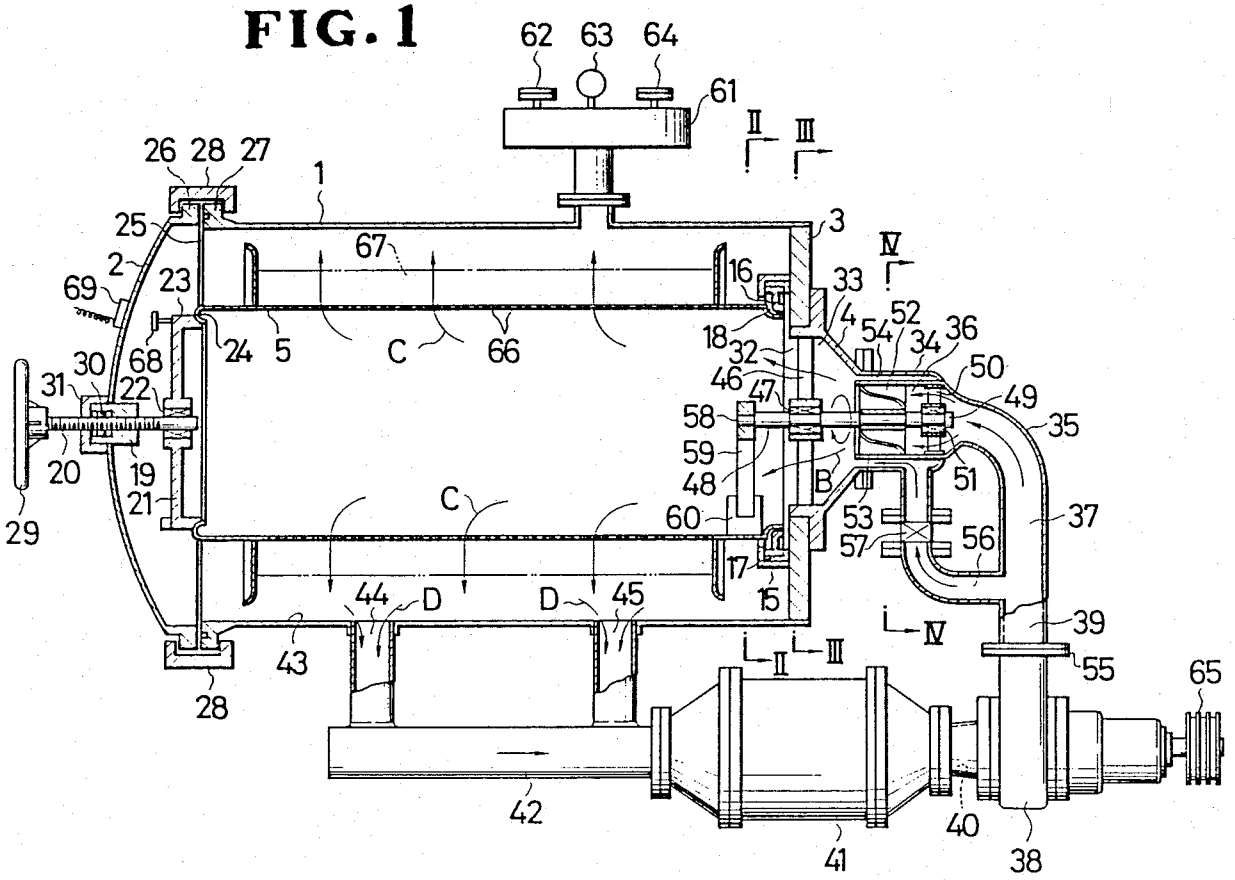
FIG. 1 is a side elevational view, partly in cross section, of a treatment apparatus embodying the present invention.

FIG. 1 shows an apparatus for treating, such as dyeing or bleaching, textile materials 67. The apparatus generally comprises a cylindrical vessel 1 having a generally circular cross-section (FIGS. 2 and 3) and extending along a generally horizontal axis. The vessel 1 is covered at one or front end tightly by an openable front lid plate 2 and at the other or rear end by an annular rear lid plate 3 and an annular frustoconical cover plate 4 (defining a liquid flow passageway 33 as described below).

A perforated cylindrical beam 5 having a substantially circular cross section is supported within the vessel 1 coaxially thereof. The beam 5 is adapted to support the materials 67 to be treated, the materials 67 being wound on the periphery of the beam 5. The beam 5 has a multiplicity of holes 66 formed in the periphery of the beam and distributed uniformly therearound, allowing treatment liquid to flow into and through the materials 67 wound on the beam.

Figure 2:
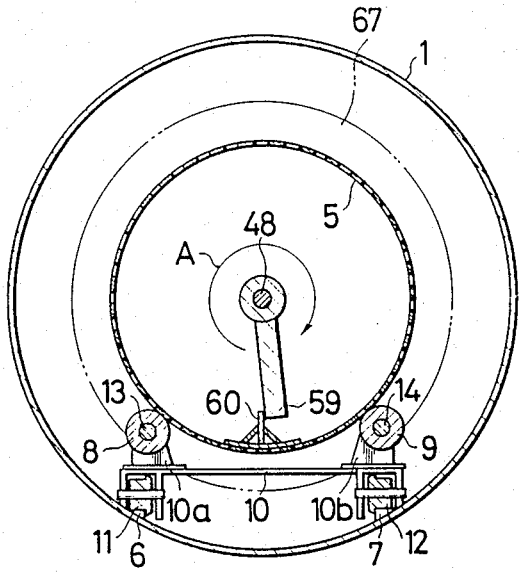
FIG. 2 is a cross-sectional view taken along line II—II of FIG. 1.

As shown in FIG. 2, the beam 5 is supported at each end by a truck 10 which has on its underside a pair of wheels 11, 12 rollable on and along a pair of parallel spaced rails 6, 7 secured to and extending longitudinally of the vessel 1. The truck 10 also has a pair of rollers 8, 9 rotatably mounted on a pair of upwardly directed arms 10*a*, 10*b* by means of a pair of pivot pins 13, 14, respectively. The beam 5 rests on the two pairs of rollers 8, 9; 8, 9 so that the beam 5 is rotatable about a shaft 48 extending axially thereof. As the beam 5 is rotated clockwise, i.e. in the direction of an arrow A by a drive mechanism (described below), the rollers 8, 9 roll on the periphery of the beam 5, during which time each roller 8, 9 is rotated counterclockwise about the respective pivot pin 13, 14.

As shown in FIG. 1, on the inner surface of the rear lid plate 3 an annular retainer 15 is mounted in which a ring 16 is rotatably received via a slide member 17 of fluorocarbon resin. The ring 16 is partly received in an annular peripheral recess 18 formed at the rear end of the beam 5.

On the other hand, a nut 19 is mounted on the front lid plate 2 coaxially of the beam 5. A pusher bolt 20 threadedly extends through the nut 19 for axial movement. A pusher disk 21 is rotatably mounted on one end (adjacent to the beam 5) of the pusher bolt 20 via a bearing 22 so as not to move axially of the bolt 20. The pusher disk 21 has a peripheral edge 23 which is engageable with an annular peripheral projection 24 formed at the front end of the beam 5. A handle 29 is mounted on the other end (remote from the beam 5) of the pusher bolt 20 for rotating the pusher bolt 20. As the pusher bot 20 is rotated in one direction by the handle 29, the pusher bolt 20 is moved toward the beam 5 to bring the peripheral edge 23 of the pusher disk 21 in contact with the annular peripheral projection 24, thus urging the rear end of the beam 5 against the ring 16.

The peripheral edge 26 of the front lid plate 2 is fluidtightly fastened to the front peripheral edge 27 of the vessel 1 by means of an annular clasp 28. Designated by 30 is a sealing ring which is mounted within the nut 30 coaxially thereof to effect a fluidtight seal between the nut 30 and the pusher bolt 20. Designated by 31 is a sealing cap covering the outer or front end of the nut 19 to assist in fluidtightly sealing.

The flow passageway 33 that is defined by the annular frustoconical plate 4 communicates at one end with the interior of the beam 5 via a central opening 32 of the annular rear lid plate 3 and at the other end with a liquid flow passageway 37 at the outlet side of a pump 38 via a liquid flow passageway 36 defined by a casing 34 and a liquid flow passageway 37 defined by a pipe 35.

A liquid flow passageway 40 at the inlet side of the pump 38 communicates with a pair of liquid flow passageways 44, 45 via a heater 41 and a connecting pipe 42. Through the flow passageways 44, 45, the treatment liquid is returned from the bottom portion 43 of the vessel 1 to the pump 38.

Figure 3:
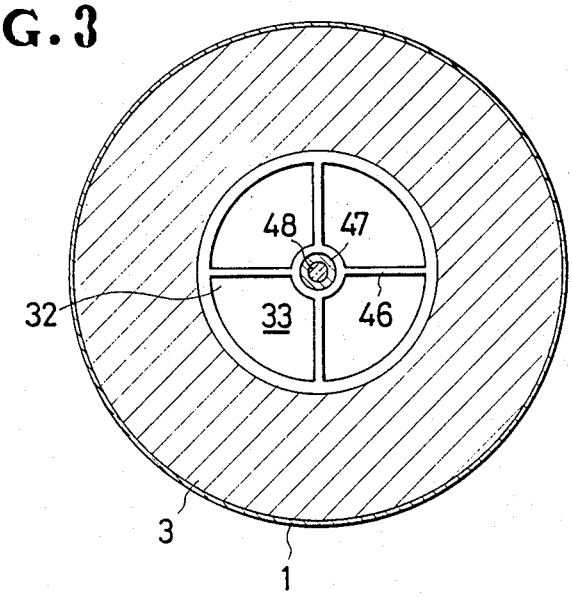
FIG. 3 is a cross-sectional view taken along line III—III of FIG. 1.

As shown in FIGS. 1 and 3, a support framework 46 in the shape of a steering wheel is mounted in the central opening 32 of the annular rear lid plate 3 and extends transversely across the flow passageway 33. The support framework 46 has a hub at which the shaft 48 is rotatably supported via a bearing 47 in alignment with the axis of the beam 5 as set in position by the pusher bolt 20.

As shown in FIG. 1, the shaft 48 extends into the casing 34 and is supported at its rear end 49 by another support framework 50 via a bearing 51. The support framework 50 has a shape similar to the shape of the first-named support framework 46.

Figure 4:
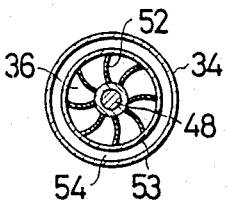
FIG. 4 is a cross-sectional view taken along line IV—IV of FIG. 1.

Most important, an impeller or vane wheel 52 (FIGS. 1 and 4) is fixedly mounted on the shaft 48 and is disposed in the flow passageway 36 defined by the casing 34, for a purpose described below.

The casing 34 is a double structure having an inner casing 53 surrounding the impeller 52 so as to define a bypass passageway 54 around the flow passageway 36. The bypass flow passageway 54 opens to the flow passageway 33, but does not open to the flow passageway 37.

The bypass passageway 54 also opens to a branch passageway 56 (FIG. 1) instead of the flow passageway 37, the branch passageway 54 being defined by a branch pipe 56 subdivided from the pipe 35. In the branch pipe 56, a valve 57 is mounted for regulating the amount of liquid flow passing through the branch pipe 56, for a purpose described below.

The front end portion of the shaft 48 extends into the beam 5. A drive arm 59 is fixedly mounted on the distal front end 58 of the shaft 48 and extends radially outwardly and terminates short of the inner surface of the beam 5. The beam 5 has a projection 60 mounted on the inner surface of the beam 5 and extends radially inwardly therefrom for engagement with the free end of the drive arm 59.

Designated by the numeral 61 in FIG. 1 is a safety unit including a safety valve 62, a pressure gage 63, and a deaerator 64. Designated by 65 is a pulley which is mounted on a shaft of the pump 38 and which is driven by a non-illustrated motor via a non-illustrated endless belt.

In operation, after the beam 5 around which a predetermined amount of textile materials 67 is mounted has been installed in position in the vessel 1 as mentioned above, the apparatus is filled with treatment liquid. As the liquid in the apparatus is circulated by the pump 38 under a predetermined air pressure, the liquid from the flow passageway 39 at the outlet side of the pump 38 flows into the flow passageway 36 via the flow passageway 37, the flow passageway 36 being surrounded by the inner casing 53.

In the inner casing 53, this liquid flow pressure causes the impeller 52 to rotate so that the drive arm 59 is angularly moved clockwise, i.e. in the direction of an arrow A in FIG. 2. Thus the beam 5 is rotated in the same direction as the projection 60 is pushed by the drive arm 59.

After having caused rotation of the impeller 52, the liquid from the flow passageway 33 flows into the interior of the beam 5 in the direction of an arrow B, and it then flows through the peripheral holes into the textile materials 66 in the direction of an arrow C.

Finally, the liquid having penetrated the textile materials 67 returns to the inlet side of the pump 38 via the passageways 44, 45, the connecting pipe 42, and the heat exchanger 41.

The rotations per minute (r.p.m.) of the shaft 48 can be controlled by regulating the amount of the liquid flow from the branch pipe 56 to the bypass flow passageway 54 by means of the valve 57.

A mechanism for transmitting the rotation of the shaft 48 to the beam 5 may be any other type.

The pump 38 may be rotatable in opposite directions; while the pump 38 rotates in one direction, the liquid flows as described above. While the pump 38 rotates in the reverse direction, the liquid then flows in the reverse direction so that the impeller 52 is also rotated in the reverse direction.

The number of rotations (r.p.m.) of the beam 5 may be detected by counting the number of rotations of the shaft 48 in a known manner. In an example, as shown in FIG. 1, a permanent magnet 68 is mounted on the pusher disk 21, and a magnetic sensor 69 is mounted on the outer surface of the front lid plate 2. With this arrangement it is unnecessary to form an aperture in the vessel 1 for the purpose of detection, thus guaranteeing an adequate degree of fluidtight sealing.

According to the present invention, since the shaft of the beam is driven by the impeller which is rotatable by the liquid flow pressure by the pump, the rotation transmitting mechanism can be mounted within a fluidtightly sealed space in the vessel.

Further, it is possible to control the rate of rotation of the impeller by a simple bypass means.

Although varius minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for treatment of textile materials with treatment liquid, comprising:

(a) a horizontally extending cylindrical vessel for containing the treatment liquid;

(b) a perforated cylindrical beam rotatably supported within said vessel concentrically thereof for supporting on and around said beam the textile materials to be treated;

(c) a shaft positioned to rotate said perforated cylindrical beam;

(d) a pump for circulating the treatment liquid within said vessel through said beam;

(e) a flow passageway communicating with said pump and with the interior of said beam; and (f) an impeller disposed in said flow passageway and drivingly connected to said shaft for rotation of said shaft by liquid flow pressure acting on said impeller in said flow passageway.

2. An apparatus according to claim 1, said shaft extending axially of said beam and having a front end disposed in said beam and a rear end disposed in said flow passageway, said impeller being fixedly mounted on said rear end of said shaft, said shaft having a drive arm extending radially outwardly from said front end for rotational movement in response to the rotation of said shaft, said beam having a projection extending inwardly from an inside surface of said beam for engagement with said drive arm.

3. An apparatus according to claim 1, said flow passageway being partly defined by a casing within which said impeller is disposed and having a conduit portion which extends between said pump and said casing.

4. An apparatus according to claim 3, including a bypass flow passageway communicating with the interior of said beam and with said pump via a branch pipe subdivided from said casing.

5. An apparatus according to claim 4, including an outer casing and an inner casing spaced from said outer casing, and surrounding said impeller, and further including a valve is mounted in said branch pipe for regulating the liquid flow pressure within said inner casing to control the rate of rotation of said impeller.

* * * * *